US007467790B2

(12) United States Patent
Westhoff

(10) Patent No.: US 7,467,790 B2
(45) Date of Patent: Dec. 23, 2008

(54) PAPER FEED ASSEMBLY

(75) Inventor: Daniel Joseph Westhoff, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 436 days.

(21) Appl. No.: 11/089,663

(22) Filed: Mar. 24, 2005

(65) Prior Publication Data

US 2006/0214357 A1 Sep. 28, 2006

(51) Int. Cl.
*B65H 85/00* (2006.01)

(52) U.S. Cl. ..... 271/3.14; 271/4.01; 271/4.08; 271/65; 271/301

(58) Field of Classification Search ..... 271/65, 271/117, 118, 301, 110, 4.01, 4.08, 3.14
See application file for complete search history.

(56) References Cited

U.S. PATENT DOCUMENTS 4,097,041 A * 6/1978 Fujimoto ..... 271/114
4,238,126 A 12/1980 Langdon
4,457,506 A 7/1984 Ashbee et al.
4,884,794 A 12/1989 Dinatale et al.
4,928,127 A * 5/1990 Stemmle ..... 399/364
5,042,791 A 8/1991 Stemmle
5,052,678 A 10/1991 Looney
5,055,885 A * 10/1991 Yoshikado et al. ..... 399/401
5,288,064 A * 2/1994 Manabe et al. ..... 271/3.08
5,316,539 A 5/1994 Leemhuis et al.
D356,816 S 3/1995 Cahill et al.
5,466,079 A * 11/1995 Quintana ..... 400/579
5,467,182 A 11/1995 Hower, Jr. et al.
5,527,026 A 6/1996 Padget et al.
5,547,181 A 8/1996 Underwood
5,564,848 A * 10/1996 Quintana ..... 400/708
5,582,399 A * 12/1996 Sugiura ..... 271/10.11
5,590,872 A * 1/1997 Oominami et al. ..... 271/176
6,072,585 A 6/2000 Dutton et al.
6,112,048 A 8/2000 Westhoff
6,135,438 A 10/2000 Newman et al.
6,152,631 A * 11/2000 Park ..... 400/708
6,181,908 B1 1/2001 Leemhuis et al.
6,186,497 B1 2/2001 Johnston
6,227,534 B1 5/2001 Schoedinger et al.
6,238,114 B1 5/2001 Bennet, III et al.
6,304,731 B1 10/2001 Able et al.
6,328,301 B1 * 12/2001 Tsujii et al. ..... 271/117
6,331,004 B1 * 12/2001 Katou et al. ..... 271/301
6,352,256 B1 * 3/2002 Hsieh ..... 271/110
6,394,447 B1 * 5/2002 Kawai et al. ..... 271/186
6,464,414 B1 10/2002 Washnock
6,547,238 B2 4/2003 Ardery et al.
6,554,270 B2 * 4/2003 Yamamoto ..... 271/117
6,586,759 B1 7/2003 Mayo et al.
6,612,566 B2 9/2003 Stoll (Continued)

*Primary Examiner*—Patrick Mackey
*Assistant Examiner*—Howard Sanders
(74) *Attorney, Agent, or Firm*—Grossman, Tucker, Perreault & Pfleger, PLLC

(57) ABSTRACT

A paper feed assembly for a printer including a media tray for a stack of sheets of media to be fed, a pick mechanism capable of pivoting including one or more picking devices in contact with said media. The pick mechanism includes a media contact member which is capable of moving the pick mechanism upon contact with advancing media to eliminate contact with the media stack.

4 Claims, 5 Drawing Sheets

U.S. PATENT DOCUMENTS 6,615,717 B1 9/2003 Perdu
6,659,449 B2 * 12/2003 Kim ..... 271/117
6,729,613 B2 5/2004 Marra, III et al.
6,834,169 B2 12/2004 Hren et al.
6,840,514 B1 * 1/2005 Westhoff ..... 271/248
7,198,265 B2 * 4/2007 Chelvayohan et al. ..... 271/110
2002/0101029 A1 8/2002 Ardery et al.
2002/0190457 A1 * 12/2002 Gaarder ..... 271/109
2004/0012139 A1 * 1/2004 Asada et al. ..... 271/113
2005/0023745 A1 * 2/2005 Morimoto et al. ..... 271/117

* cited by examiner

PAPER FEED ASSEMBLY

FIELD OF THE INVENTION

The present invention relates to an apparatus and a method for processing media through a printer.

BACKGROUND OF THE INVENTION

To produce copies an electrophotographic printer prints an image on media, such as sheets of paper, from toner contained in a toner cartridge. A developer roller or sleeve is mounted within the toner cartridge in proximity to a photoconductive drum. The photoconductive drum is charged, and a laser scans the charged photoconductive drum with a laser beam to discharge the surface and form a latent image thereon. The developer roller attracts statically charged toner from the toner container. Toner is transferred from the developer roller to the photoconductive drum to develop the latent image formed on the photoconductive drum. The developed image is then transferred to statically charged sheets of media. The sheets are fed through a heated fuser assembly, where the heat fixes the visible image.

A typical image forming apparatus, such as an electrophotographic printer, includes a media sheet supply system having a sheet feed assembly and a supply tray which holds a plurality of print media sheets, such as paper. The media sheets are held in the supply tray until a print job is requested, and ideally are transported one by one to the photoconductive drum within the printer where a latent image is transferred thereto.

One type of sheet feed assembly is an auto compensating sheet feeding assembly or pick mechanism. The auto compensating sheet feeding assembly includes a pick roller (or pick rollers) and a gear train which transmits both a rotational force and a downward force to the pick roller. In such an auto compensating sheet feeding assembly, the pick arm is pivoted around its input gear causing a rotation of the pick arm and pick roller to apply increasing pressure by the pick roller to the top sheet until the top sheet is moved.

In a printer having a media path with both simplex and duplex capabilities, a single sheet of media is separated from the top of a stack of sheets of media in a media tray. The sheet of media is then transported through a printer during its printing process. In a duplex operation, the direction of motion of the sheet of media is typically reversed after its trailing edge is released from fuser exit rollers of a laser printer. After the direction of motion of the sheet of media is reversed, it must be realigned in the duplexer path to the correct position and orientation prior to entering again into the printer input path. To align the sheet of media with the reference edge to its correct position and orientation, alignment rollers may be employed. These alignment rollers may be skewed so that they may apply both a force perpendicular to the reference edge and a force parallel to the reference edge to advance the sheet of media.

SUMMARY OF THE INVENTION

In a first exemplary embodiment, the present invention is directed at a paper feed assembly for a printer comprising a media tray for a stack of sheets of media to be fed. A pick mechanism is included that is capable of pivoting and which includes one or more picking devices in contact with the media. The pick mechanism further includes a media contact member wherein the member is capable of moving the pick mechanism to eliminate contact with said media.

In a second exemplary embodiment, the present invention is directed at a printer for printing images on media comprising a media feed path capable of directing sheets of media through said printer. A media transport mechanism is provided that is capable of feeding the sheets of media along the media feed path, along with a media transport initiating mechanism capable of initiating the feeding of sheets of media along the feed path. One or more diverters are included that are capable of directing the sheets of media along a simplex path or a duplex path and a media input tray is provided for the sheets of media wherein the duplex path is capable of passing the sheets of media between the media transport initiating mechanism and the tray.

In another exemplary embodiment the present invention is directed at a method for providing second side copying to form duplex copies in an electrophotographic device. The method comprises the steps of providing a media feed path for feeding sheets of media through the device and providing a media tray including one or more sheets of media arranged in a stack. A pick mechanism is provided that includes an arm having opposite ends, the arm coupled to one or more pick rollers at one end and pivoted about the opposite end. The one or more pick rollers are in contact with the media stack to initiate the movement of the top sheet of media in to the device. The arm also includes a driver for rotating the one or more pick rollers. The pick mechanism further includes a paper contact arm having opposite ends, coupled to the pick mechanism and extending into the media feed path. One then may direct the passage of sheets of paper between the pick mechanism and the stack of media.

BRIEF DESCRIPTION OF THE DRAWINGS

These and other features, aspects, and advantages of the present invention will be better understood when the following Detailed Description is read with reference to the accompanying drawings wherein.

DETAILED DESCRIPTION OF THE INVENTION

Figure 1:
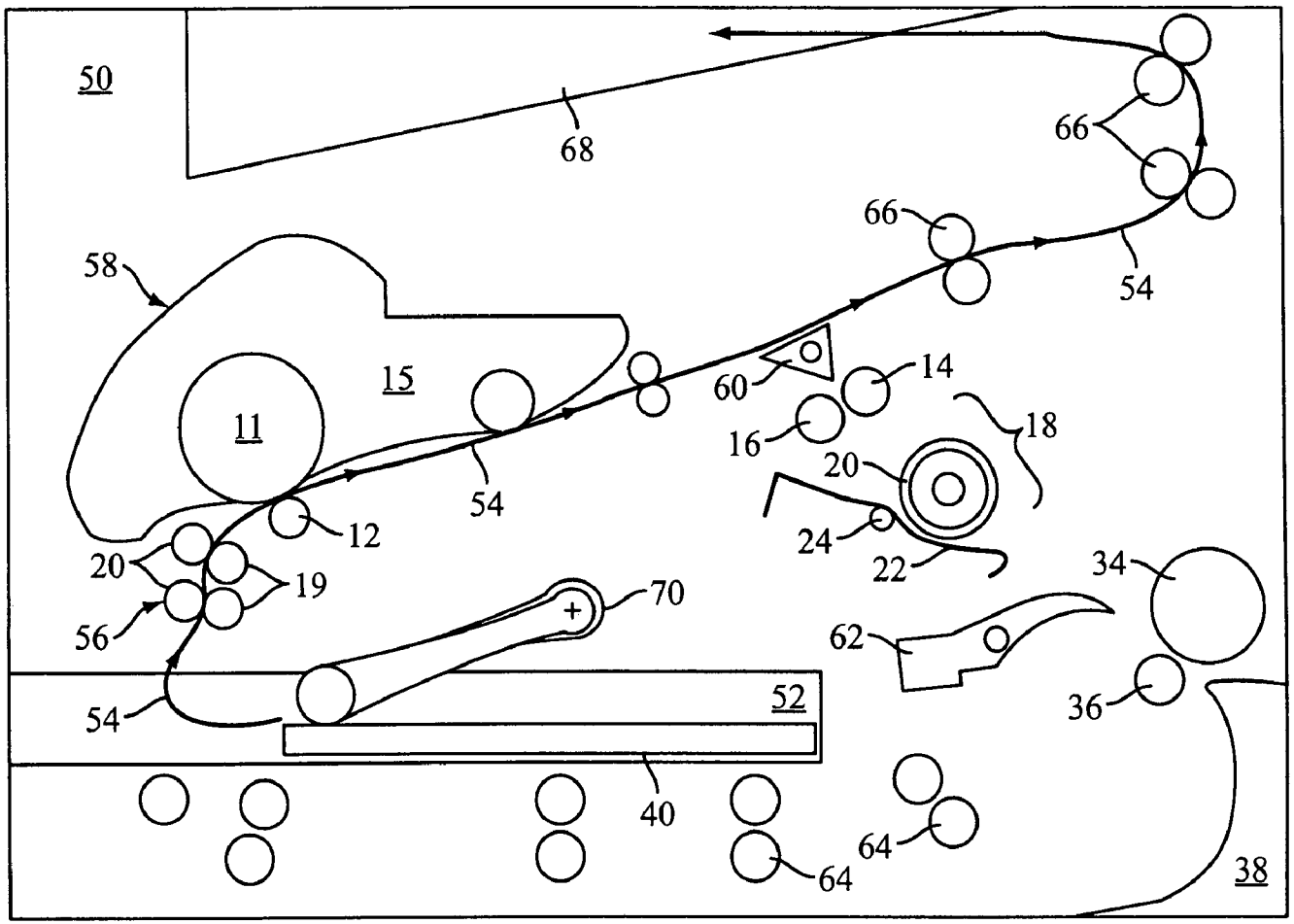
FIG. 1 is a schematic side view of a portion of an exemplary electrophotographic device illustrating the path taken for a simplex copy, with parts omitted for clarity purposes and taken from the right side.

FIG. 1 shows an electrophotographic printer. The apparatus is enlarged for clarity. The printer 50 includes a paper or media input tray 52 and at least one sheet of paper, the path of which is indicated at 54. An input system 56 may feed the paper from a stack 40 in the input tray 52 to a print engine 58. The print engine may be responsible for writing, transferring, and fusing an image on the paper as is conventionally known in the art and previously described herein. Within the print engine 58 a photoconductive drum 11 and a toner transfer roll 12 may cooperate with each other and receive toner from a cartridge 15. The input system 56 may include drive rollers 19 cooperating with idler rollers 20 to advance the sheet for printing.

FIG. 1 further illustrates the path 54 that a sheet of paper may follow to produce a simplex, that is, one sided, copy of an image. A sheet of paper may be fed from the paper tray 52, by a media transport initiating mechanism, such as a D-shaped roll or autocompensator pick mechanism 70, through a series of drive rollers 56 and into engagement with the print engine 58 for image transfer and fixing. The sheet of paper may next proceed on its (simplex) path past an open diverter gate 60 and through a series of output rollers 66, finally arriving at an output tray 68. The input system rollers 56 and output rollers 66 may define a media transport mechanism.

Figure 2:
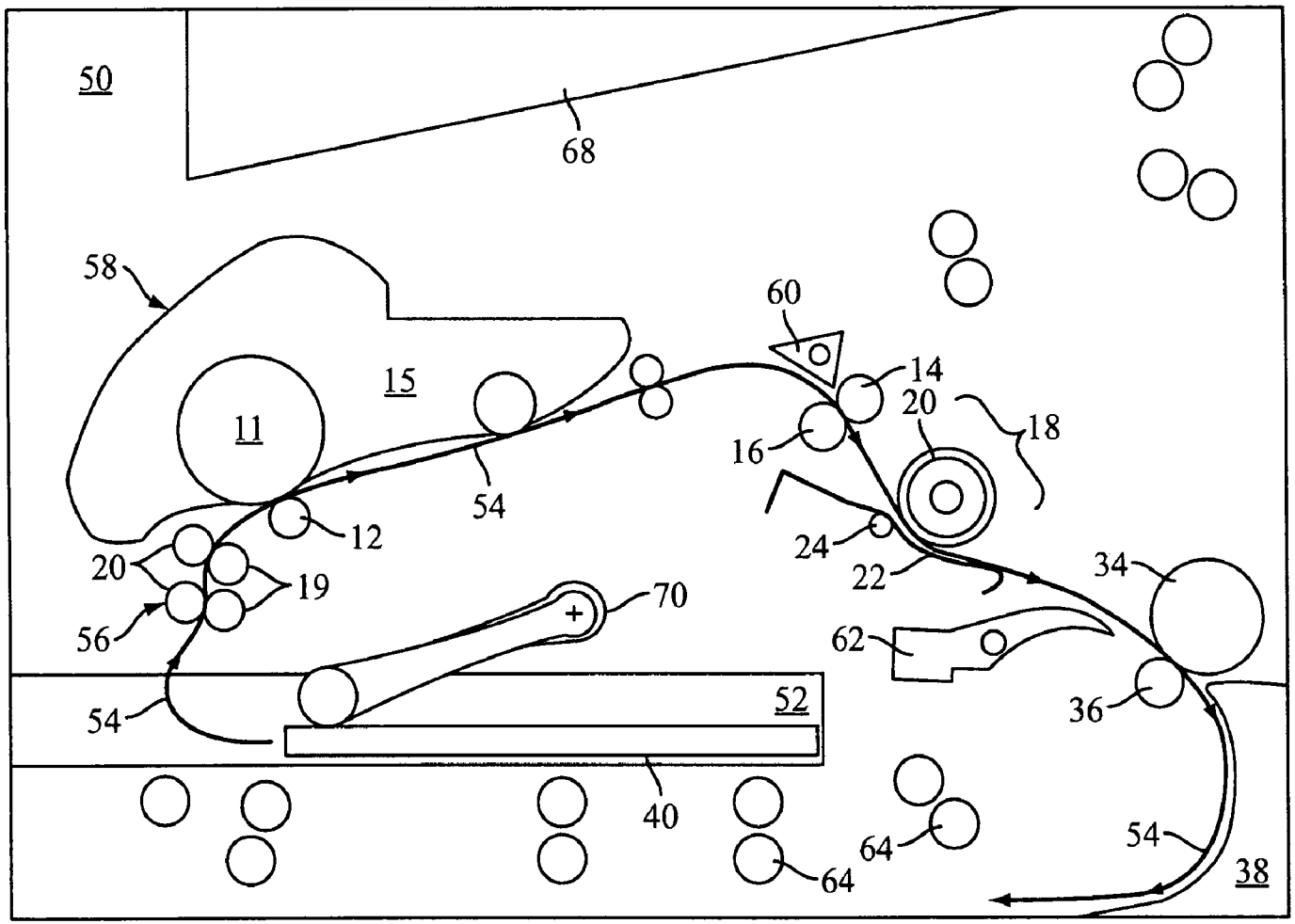
FIG. 2 is a schematic side view of a portion of an exemplary electrophotographic device illustrating the path taken for copying on the first side for a duplex copy, with parts omitted for clarity purposes and taken from the right side.

FIG. 2 shows the same electrophotographic printer configured to print an image on one side of a sheet of paper, but in duplex mode. The path 54 of the sheet of paper may be the same initially in duplex mode as in simplex mode, as shown in FIG. 1, through drive rollers 56 and into engagement with print engine 58, where an image is transferred to the first or front side of the sheet of media. The sheet next may reach a first diverter gate 60. The diverter gate 60, informed that the copy is to be a duplex, may be closed and divert the paper away from the simplex path (as shown in FIG. 1) and into a reversing apparatus for inverting the sheet for copying or imaging on the reverse, or second, side. The printer 50 may further include a paper curling apparatus as shown, and as described in U.S. Pat. No. 6,112,048, commonly assigned to the assignee of the present invention and incorporated by reference herein. Pinch rollers 14 and 16 may feed the sheet of paper into a compensating bend mechanism 18. As the paper contacts the curl guide 22, the curl guide pivots around pin 24 and biases a spring (not shown). The paper exits curl guide 22 and may contact a second diverter gate 62. This second diverter gate 62 may direct the paper into drive roller 34 and idle roller 36. The rollers may drive the paper into recurl channel 38. The recurl channel may induces a negative curl which corrects the positive curl generally found in heavy weight paper after processing through a print engine.

The paper travels along the surface of recurl channel 38 until the trailing edge of the paper clears second diverter gate 62. When the paper clears the second diverter gate, the pinch rollers 34, 36 may stop driving the paper and the second diverter gate 62 may be flipped upward. It should be appreciated that the curl guide and recurl channel described herein may be substituted by other paper directing means to direct the duplex sheet into a position where it will be inverted for second side printing.

Figure 3:
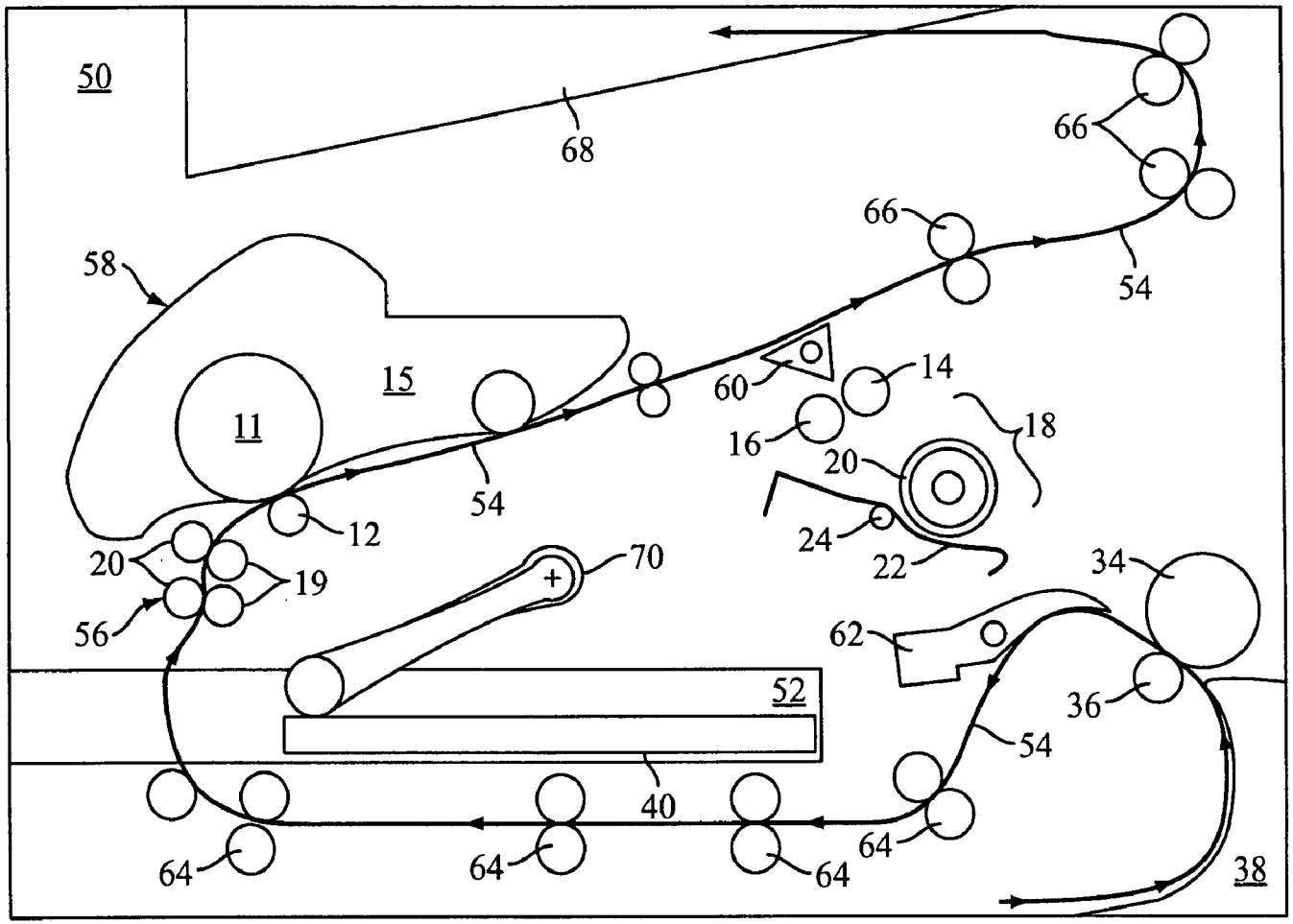
FIG. 3 is a schematic side view of a portion of an exemplary electrophotographic device illustrating the path taken for copying on the second side for a duplex copy, with parts omitted for clarity purposes and taken from the right side.

FIG. 3 shows the remainder of the duplexing path (second pass) for the exemplary printer once the paper has cleared the second diverter gate. With the second diverter gate 62 flipped upward, the rollers 34, 36 may reverse direction. This may now drive the paper into the second diverter gate 62 and what was the trailing edge of the sheet of paper for the first pass of duplex copying becomes the leading edge for the second, or return, pass. The diverter gate 62 may direct the paper along a path 54 as indicated by the arrows, into a system of duplex rollers 64 generally located beneath the input media tray 52. This system of rollers 64 may generally include one or more drive rollers cooperating with alignment rollers. The rollers may direct the paper along a path back into the input system 56. This return duplex path shown as 54 in FIG. 3 may include a pair of substantially parallel spaced elements or curved surfaces (not shown for clarity) that define the predetermined return feed path for the sheets of paper. The input system may deliver the paper, with the unprinted side now facing upward, into the print engine 58. The paper now has an image fused onto each side of the paper, and the paper is once again directed to first diverter gate 60. Because duplexing is no longer desired, the first diverter gate 60 may be opened and direct the paper into output system 66. The sheet of duplexed paper may then be delivered to an output tray 68 as a two-sided, or duplex copy.

Figure 4:
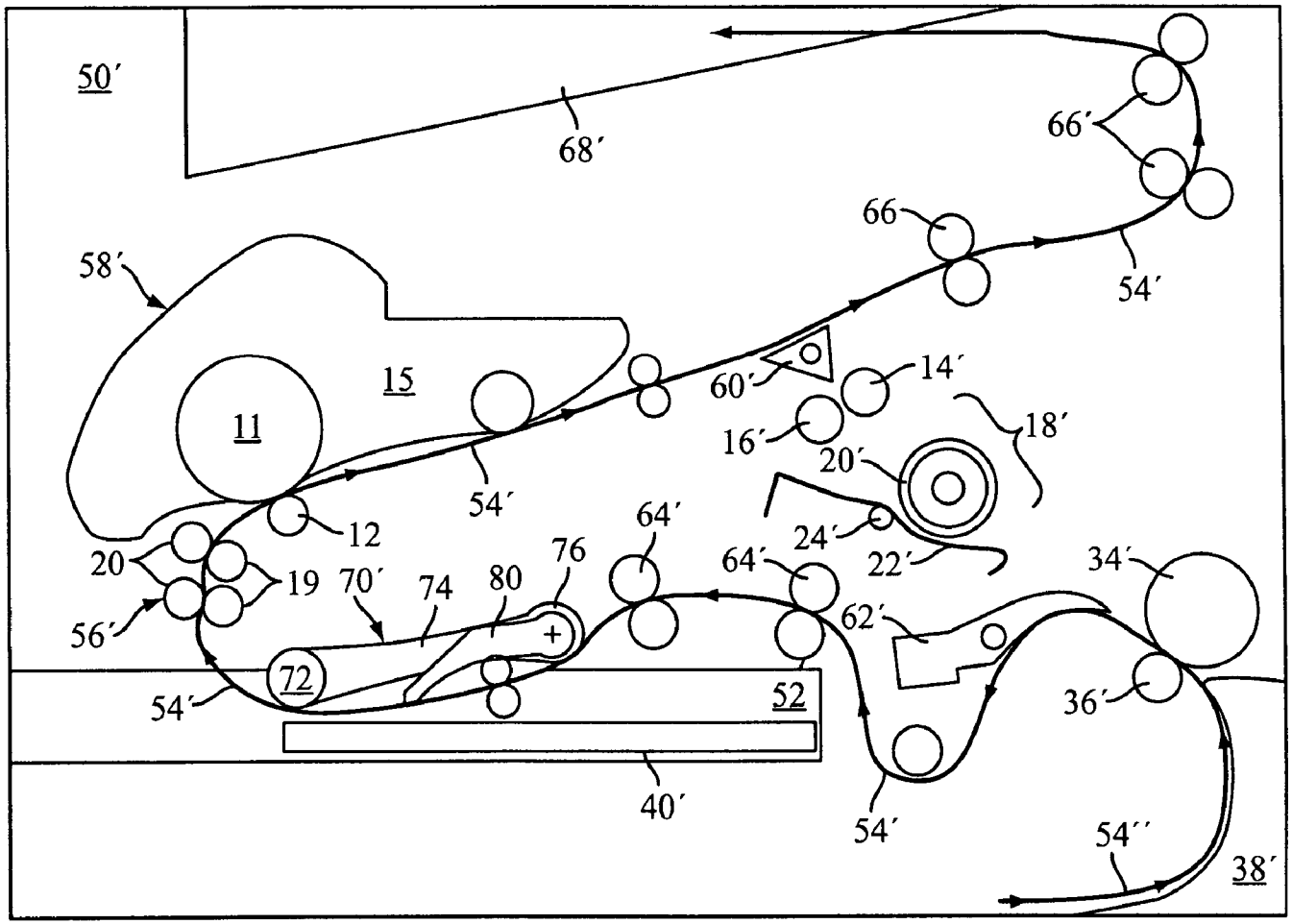
FIG. 4 is a schematic side view of a portion of an exemplary electrophotographic device illustrating the path taken for the second side copying for a duplex copy.

Turning now to FIG. 4, an exemplary embodiment of the apparatus and method of providing an image on the reverse or second side of a sheet of paper will be described. The apparatus 50' may be similar to that described above. In the paper tray 52', a pick mechanism 70' may be provided to individually pick sheets of media from the top of stack 40' and deliver them to input system 56 (for simplex and first pass duplex copying). Simplex and first pass duplex copying may proceed as described previously in FIGS. 1 and 2 respectively.

The pick mechanism 70' may be an autocompensator of the type shown and described in U.S. Pat. No. 5,527,026 to Padget, et al. and incorporated by reference herein. Alternatively, the autocompensator pick mechanism may be as shown and described in U.S. Pat. No. 6,227,534 to Schoedinger, et al. and incorporated by reference herein. It should be understood that the pick feed mechanism 70' may be other than the autocompensator of the aforesaid Padget, et al. or Shoedinger, et. al. and may have one or more pick rolls, as desired. An autocompensator is reference to a device that applies increasing pressure to a top sheet of media until such sheet is moved.

One preferred autocompensator pick mechanism 70' may include a pick roller (or rollers) 72 and a pivoting swing arm 74 which may include a gear train (not shown) that transmits both a rotational force and a downward force to the pick roller. The pick roller 72 may be mounted on one end of the pivoting swing arm 74. The roller may rest on the paper stack 40' in the paper tray 52'. The arm may pivot around the opposite end. See FIG. 5. When the pick roll drive is initiated through a gear 76 located on the pivot shaft of the swing arm and counter rotating to the direction of feed, a torque is applied to the swing arm through the downstream gear train which pivots the swing arm 74 and pick roller 72 into the paper stack. The normal force generated is dictated by the buckling resistance of the media being picked.

In such a mechanism, the pick arm 74 may be pivoted around its input gear 76 causing a rotation of the pick arm 74 and pick roller 72 to apply increasing pressure by the pick roller until the top sheet of paper stacked in tray 52 is moved. A dam or corner buckler may be used (not shown) to ensure separation of the top sheet from the stack. After the drive force to the pick roll is discontinued, the sheet in process may input rotation to the pick roller 72 that causes the swing arm 74 to rotate up to a point where the normal force on the top sheet in the stack theoretically goes to zero. The autocompensator pick mechanism 70 may also include a paper contact arm 80 which may be coupled to the pivoting swing arm 74 at one end and may be in contact with the top sheet of the stacked media in the media input tray 52 at the other end.

Turning to the path of travel 54' of the duplex sheet, the sheet of paper, already printed on one side due to the first pass of the duplex copy through the print engine 58', has cleared the second diverter gate 62' and may reside in the recurl channel 38 as 54". The rollers, 34, 36 may now reverse direction and drive the paper along new path 54' into (now flipped up) second diverter 62'. This directs the paper along a path 54' through a series of duplex rollers 64' located above the media input tray 52'. This may provide a shorter (faster) path for the duplex sheet to accomplish its return path for second side printing. It may further allow for easy removal of media jams as they may be accessed by removing the tray 52'.

Since the path 54' may now be above the input tray 52' one may pass the paper between the autocompensator pick mechanism (ACM) 70 and the paper stack 40'. To do so, the ACM may be lifted off the stack to provide an open path for the duplex return sheet. This might be accomplished by a number of methods, using lifting motors, drive mechanisms, etc. The present invention may therefore provide a simpler and less expensive method wherein the sheet of paper, traveling along its duplex return path, may engage the paper contact arm 80 and may cause it to lift, which in turn may lift the end of the ACM 70 which includes the pick rollers 72. This may provide the open path for the duplex return sheet to engage the input drive rollers 56'. The duplex sheet, now inverted by its travel through the recurl channel 38, may now be printed on its second or reverse side. The sheet may then proceed as if in simplex mode past open first diverter gate 60' through output drive rollers 66' and into output tray 68'.

Figure 5:
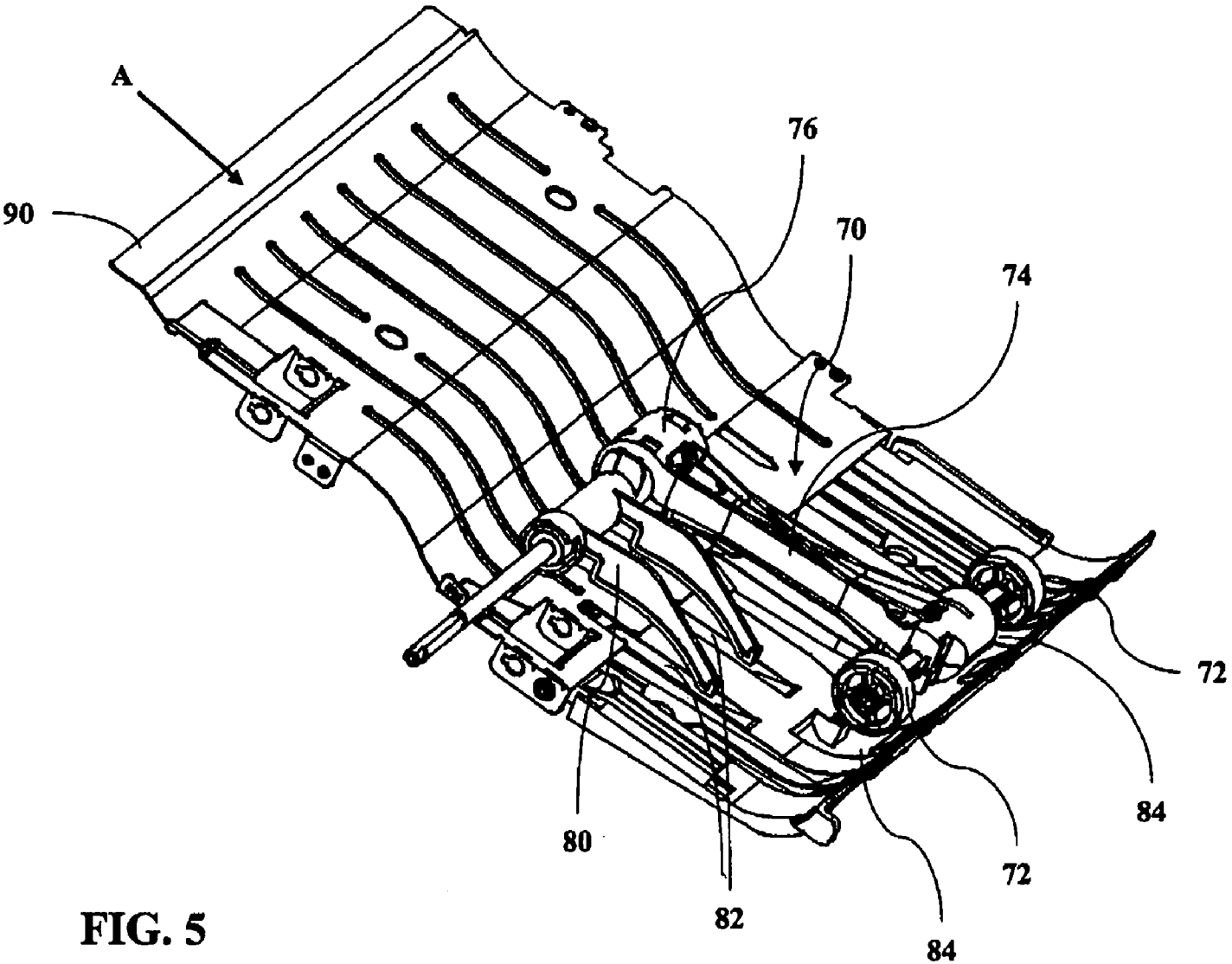
FIG. 5 is a perspective view of the device of FIG. 4 from above the media input tray and autocompensator pick mechanism, illustrating a lower support surface.

One may direct the duplex return sheet along its path 54' between the lifted ACM 70 and the paper stack 40, via a pair of substantially parallel spaced elements or curved surfaces 90 that define the predetermined return feed path for the sheets of paper. The lower of these elements is shown in FIG. 5. These elements may be molded of plastic and may be shaped to provide a chute that directs the path of the sheet through the printing apparatus.

FIG. 5 is a perspective view of the autocompensator pick mechanism (ACM) 70 and paper contact arm 80 of FIG. 4 which may be located above the lower element or support surface 90. The sheet of paper may be driven along the surface of lower element 90 in the direction of arrow A (the upper element is not shown for clarity) by rollers 64' See FIG. 4. Prior to the sheet of paper, on its duplex return path 54', arriving at the ACM 70, the pick rollers 72 may extend through slots 84 in the lower element so that they may be in contact with the top sheet in the underlying stack 40' (see FIG. 4). The stack may be spring loaded from underneath to ensure contact of the top sheet with the rollers. An upper element may be arranged generally parallel to and spaced from the lower element 90, and not shown in FIG. 5, which may also include upper slots similar to 82 and 84 noted above, through which an end of the contact arm and the pick rollers may extend. The pick roller may therefore extend through both the upper and lower slots to contact the stack of media. The contact arm may only extend through the upper slots to contact an advancing sheet of media which may be directed on its path between upper and lower paper support elements. Thus, the autocompensator pick mechanism may lie above the parallel support elements that form the chute to direct the sheets of paper along the duplex return loop.

As the sheet of paper, advancing in the direction of arrow A in FIG. 5, moves along the upper surface of lower element 90, it may encounter paper contact arm 80 and may cause it to lift. Since the paper contact arm may be coupled to the pick mechanism, this may cause the ACM 70 to pivot upward (via pivot arm 74) lifting the pick rollers 72 away from contact with the top sheet. This then allows an open path for the duplex sheet to travel under the pick rollers 72 and into the input feed system 56' (see FIG. 4). The sheet may then have an image fixed on the second, or back side, by print engine 58 to provide a two-sided duplex copy which may then travel past the open diverter 60' and then through the output system 66 to the output tray 68 as shown in FIG. 4. The ratio of the length of the pivot arm 74 to the length of the paper contact arm 80 may define the amount that the pick rollers 72 will be raised off the top sheet of the stack.

Accordingly, one exemplary feature of this invention is that a shorter more direct path for the return of duplex media may be provided. Another exemplary feature of the present invention is that an efficient method of providing a path for the sheet of paper between the ACM and paper stack may be provided without the need for mechanical drives, motors or complex lifting mechanisms. All of this may provide increased productivity, reduced complexity and increased printing speed, that may result in a smaller less complex printing device. In addition, it should be noted that these are exemplary features and are not at all individually or collectively limiting of the present invention.

For purposes of exemplification, various embodiments of the invention have been shown and described. However, it will be apparent that changes and modifications in the arrangement and construction of parts thereof may be resorted to without departing from the spirit and scope of the invention.

What is claimed is:

1. A method for providing second side copying to form duplex copies in an electrophotographic device, said method comprising the steps of:

providing a media feed path for feeding one or more sheets of media through said device;

providing a media tray including one or more sheets of media arranged in a stack;

providing a pick mechanism comprising an arm having opposite ends, coupled to one or more pick rollers, said arm pivoted about one end, said one or more pick rollers located at said opposite end and in contact with said media stack, said arm further including a driver for rotating said one or more pick rollers, said pick mechanism further including a media contact arm having opposite ends, wherein one of said opposite ends is configured to contact said stack or media tray and wherein said paper contact arm is coupled to said pick mechanism and extends into said media feed path;

directing the passage of sheets of paper between said pick mechanism and said stack of media, wherein a sheet of media traveling along said feed path engages with said paper contact arm and lifts said one or more pick rollers off said stack, providing a path for said sheet to pass between said stack and said pick mechanism without contacting said one or more pick rollers.

2. The method of claim 1 including the additional step of providing a support surface for directing the passage of said sheets of media.

3. The method of claim 2 wherein said support surface includes at least one opening and wherein said one or more pick rollers extend through said opening.

4. The method of claim 1, further including a media transport initiating mechanism capable of initiating the feeding of sheets of media along said feed path, wherein said media transport initiating mechanism comprises an autocompensator pick mechanism.

* * * * *